United States Patent [19]

Brown, Jr.

[11] 4,165,622

[45] Aug. 28, 1979

[54] RELEASABLE LOCKING AND SEALING ASSEMBLY

[75] Inventor: Milton R. Brown, Jr., Riverside, Calif.

[73] Assignee: Bourns, Inc., Riverside, Calif.

[21] Appl. No.: 681,986

[22] Filed: Apr. 30, 1976

[51] Int. Cl.[2] ..... G04B 37/08; B65D 53/00

[52] U.S. Cl. ..... 64/4; 277/168; 277/170; 277/171; 277/177; 277/173

[58] Field of Search ..... 64/5, 4; 403/326; 338/183, 176, 180; 277/168, 170, 171, 165 B, 214, 177, 169, 173; 285/321, DIG. 19; 29/208 R

[56] References Cited

U.S. PATENT DOCUMENTS

| | | | |
|---|---|---|---|
| 1,526,008 | 2/1925 | Olson | 403/326 |
| 2,368,611 | 1/1945 | Charnock | 403/326 |
| 2,390,445 | 12/1945 | Mercier | 285/321 |
| 2,453,391 | 11/1948 | Whittingham | 285/321 |
| 2,630,338 | 3/1953 | Snyder | 285/321 |
| 2,631,871 | 3/1953 | Stone | 277/171 |
| 2,812,958 | 11/1957 | Rogers | 285/321 |
| 2,863,186 | 12/1958 | Olson | 277/171 |
| 2,876,987 | 3/1959 | Renfro | 277/170 |
| 2,904,766 | 9/1959 | McMillan | 338/176 |
| 3,070,649 | 12/1962 | Elden | 285/321 |
| 3,318,401 | 5/1967 | Carbert | 403/326 |
| 3,347,293 | 10/1967 | Clark | 403/326 |
| 3,381,983 | 5/1968 | Hanes | 285/321 |
| 3,392,360 | 7/1968 | Guggenheim et al. | 338/176 |
| 3,727,879 | 4/1973 | Lange | 277/177 |
| 3,785,142 | 1/1974 | Soguel | 277/169 |

*Primary Examiner*—Charles J. Myhre
*Assistant Examiner*—R. C. Turner
*Attorney, Agent, or Firm*—Paul H. Ware; William G. Becker

[57] ABSTRACT

A releasable locking and sealing assembly for a cylindrical casing which fits over a body. The body includes a cylindrical portion about which an O-ring formed from a stiffly deformable, springy material is disposed. The casing is dimensioned to compress the O-ring as it is slid over the body, and includes an annular groove around its interior cylindrical wall, the width of the groove being no greater than the width of contact between the casing wall and the O-ring when compressed. When aligned with the groove, an annular portion of the O-ring is crimped to form a seal between the body and casing which resists axial movements of the casing relative to the body. However, the seal yields to an axial force coupled with a twisting force on the casing, thereby permitting the casing to be locked in sealing relation to the body but readily removed when desired. The invention is of particular usefulness in a linear motion potentiometer.

3 Claims, 4 Drawing Figures

RELEASABLE LOCKING AND SEALING ASSEMBLY

BACKGROUND OF THE INVENTION

This invention relates to locking and sealing assemblies, and more particularly to means for sealing the interior of a linear motion potentiometer (LMP) body which is enclosed by a casing during operation but must be accessible from the outside at other times.

It is often necessary to seal instrument assemblies against harmful operating environments and yet have convenient access to the instrument when desired for cleaning and maintenance. For example, in order to measure the cross section of an oil well at various levels a number of LMP's may be dropped to the lowest level of the well and then drawn up toward the surface. An operating rod emanating from each LMP maintains contact with the side of the well and is pushed into or out from the potentiometer according to the measured well dimension at each level. The LMP's are normally enclosed in a protective casing, but must be periodically opened for removal of any oil which may have entered and dirtied the instrument elements.

There are thus two factors in the construction of such devices that have conflicted to a certain extent in the past: the need for a good environmental seal to protect the interior mechanism, and the ability for the device to be readily disassembled for servicing and cleaning and then reassembled. A common technique has been to provide O-rings around each end of the instrument body which are compressed by the casing as it is slid over the body, thereby forming a secure seal. To secure the casing to the body it has been necessary to use auxiliary devices such as screws or locking rings. While a satisfactory seal can be obtained in this manner, the disassembly and reassembly procedures necessary to remove the casing from the body for servicing the instrument and then repositioning the casing are somewhat cumbersome and subject to improvement in terms of both the complexity of the apparatus and the time required for each operation.

SUMMARY OF THE INVENTION

In view of the above stated problems associated with the prior art, it is an object of the present invention to provide a novel and improved body and casing assembly in which the casing may be releasably locked in sealing relation to the body.

Another object of the invention is the provision of such an assembly in which the need for auxiliary devices to fasten the casing onto the body is eliminated.

Still another object is the provision of such an assembly in which the casing can be locked in place in sealing relation to the body and then readily removed merely by twisting the casing as it is slid onto or off the body.

Yet another object is the provision of an LMP having a releasable locking and sealing assembly as described above.

In the realization of these and other objects, the invention contemplates releasably locking and sealing together an assembly comprising a body and a protective cylindrical casing. An O-ring formed from a stiffly deformable, springy material is disposed about a cylindrical portion of the body. The casing, the inner diameter of which is at least as great as the other diameter of the cylindrical body portion but less than the principal diameter of the O-ring, can be slid over the body to compress the O-ring. The casing includes an annular groove around its interior cylindrical wall, the width of which groove is no greater than the width of contact between the interior casing wall and the O-ring when compressed by the casing. When the groove is aligned over the O-ring, an annular portion of the O-ring is crimped in the groove. As a result the O-ring not only forms a seal between the body and casing, but resists axial movements of the casing relative to the body to prevent the casing from being accidentally dislodged. At the same time, however, the O-ring seal yields to an axial force coupled with a twisting force on the casing relative to the body. The casing can thereby be releasably locked in sealing relation to the body and then removed simply by twisting it as it is moved axially.

In a preferred embodiment the O-ring is seated in an annular recess formed around the cylindrical body portion. Preferred dimensions for the O-ring, groove, and recess are described. The invention is particulary adapted to a sealed LMP in which the described locking and sealing mechanisms are provided at each end.

DESCRIPTION OF THE DRAWINGS

Further advantages and features of the invention will be apparent to those skilled in the art from the ensuing detailed description thereof, taken together with the accompanying drawings, in which.

DESCRIPTION OF A PREFERRED EMBODIMENT

Figure 1:
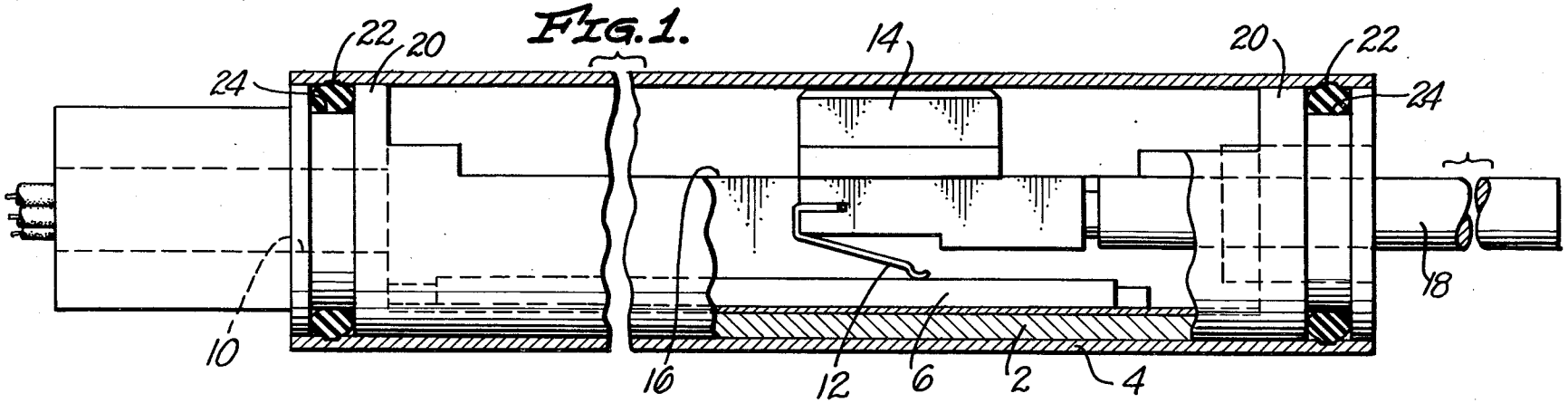
FIG. 1 is a sectional view of an LMP employing the locking and sealing mechanism of the present invention.
Figure 2:
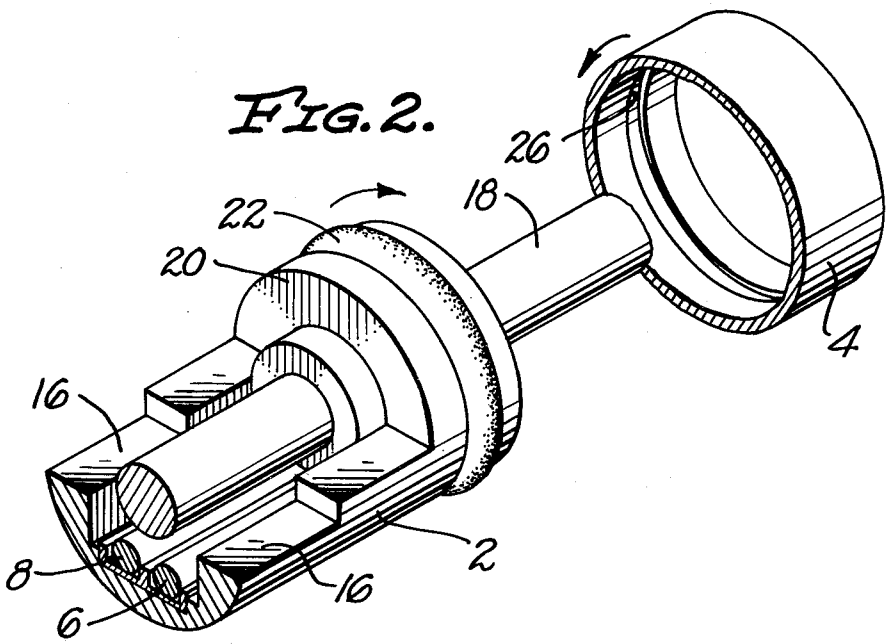
FIG. 2 is an exploded perspective view illustrating the one-step assembly procedure made possible by the present invention.

Referring to FIGS. 1 and 2, an LMP is shown having a housing formed by an elongate body 2 and an outer hollow cylindrical casing 4. Secured to the floor of body 2 and extending longitudinally thereon are a resistance track 6 and a collector track 8. Resistance track 6 has a coating or wound layer of a suitable resistance material, while collector track 8 is formed from an electrically conductive material. Lead wires associated with each of the tracks enter the housing through a sealed opening 10 at one end. An electrical and mechanical connection between resistance and collector tracks 6 and 8 is made by an electrically conductive contact spring 12 having a pair of depending wiper fingers which wipe respectively against the resistance and collector tracks. The contact spring 12 is secured to a mounting block 14 such that the spring fingers are flexed against their respective tracks. Mounting block 14 rides along platforms 16 formed longitudinally on either side of the LMP. Movement of contact spring 12, the position of which determines the electrical output of the device, is controlled by a drive rod 18 which extends into the housing through a sealed opening at the end of body 2.

The LMP as described thus far can be of conventional construction. The present invention concerns the mechanism by which casing 4 is secured to body 2, and the seal formed therebetween. This mechanism includes cylindrical end portions 20 formed at each end of body 2. Since the locking and sealing mechanisms at both ends of the instrument are substantially identical, only one will be described and the same reference numerals will be employed for both ends.

Figure 3:
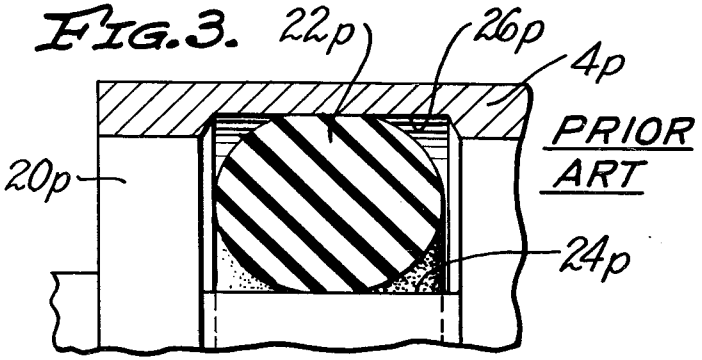
FIG. 3 is an enlarged fragmentary sectional view of a sealing mechanism employed in the prior art.

In order to fully appreciate the contribution made by the present invention, it will be useful to first briefly review an approach taken in the past. FIG. 3 illustrates a common method of sealing the interior of an LMP employed in the prior art. An O-ring 22*p* is seated in an annular recess 24*p* formed around a cylindrical end portion 20*p* of the LMP body. O-ring 22*p* is larger in cross-sectional diameter than the depth of recess 24*p* and protrudes outwardly therefrom to be compressed into the recess when casing 4*p* is slid over the body. An annular groove 26*p*, having a width approximately equal to that of recess 24*p*, is formed around the interior cylindrical wall of casing 4*p* and registers with recess 24*p* when the casing is centered over the body. In this position O-ring 22*p* is compressed between groove 26*p* and the floor of recess 24*p* and forms an environmental seal for the interior of the LMP. With the construction described thus far, however, casing 4*p* can unintentionally be dislodged from the body during use. It is therefore necessary to add auxiliary means (not shown) to fasten the casing in place. Such means have typically taken the form of screws extending through the casing into the body, or a locking ring or collar clamped around the casing. In order to remove the casing to service the LMP, whatever fastening device has been used must be disassembled and the casing then slipped off the body. After servicing the casing is slid back over the body and the fastening device must then be reassembled. This two-step operation required each time the casing is either removed or replaced adds to the time required for servicing, and the required auxiliary fastening device also increases the cost of the LMP.

Figure 4:
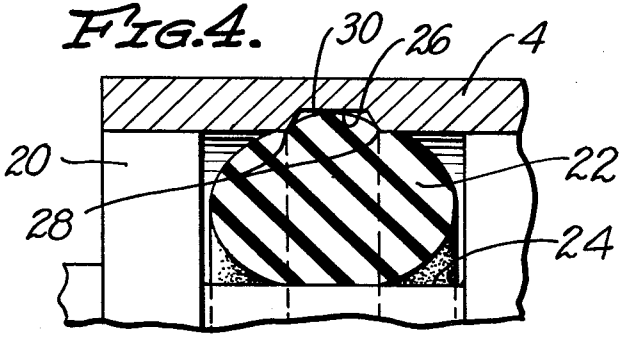
FIG. 4 is an enlarged fragmentary sectional view similar to FIG. 3 showing details of the improved locking and sealing mechanism described herein.

The improved locking and sealing mechanism of the present invention is illustrated in detail in FIGS. 1, 2, and 4. This simplified mechanism eliminates the need for any auxiliary fastening devices, and reduces the effort required to either emplace or remove the casing to a simple one-step operation. Seated in an annular recess 24 around each body end portion 20 is an O-ring 22 formed from a stiffly deformable, springy material such as the fluorocarbon elastomer produced by the E. I. Dupont De Nemours Company under the registered trademark VITON. The principal diameter of the O-ring (its greatest dimension through the center of end portion 20) is greater than the inner diameter of casing 4, and the diameter of a cross section of the O-ring material is greater than the depth of recess 24. O-ring 22 accordingly protrudes out of recess 24 and is compressed as casing 4 is slid over. Preferably only a slight radial clearance is left between body 2 and the interior wall of casing 4.

Around the interior cylindrical wall of each end of casing 4 and spaced equidistantly with O-rings 22 is an annular groove 26, the width of which is no greater than the width of the contact area established between the non-grooved portion of the interior casing wall and each O-ring. As shown in FIG. 4, O-ring 22 remains compressed and in contact with casing 4 from the lips 28 of groove 26 outwardly to the end of the contact area when groove 26 is centered over it. This compression is relieved, however, along the central annular portion of the O-ring, which is permitted to bulge outwardly into the groove, forming a bead 30. It has been found that by thus crimping the O-ring, casin 4 is not only sealed with respect to body 2, but is tightly engaged and cannot be axially removed from the body except by very strong axial forces greater than those normally encountered in operation of the LMP.

In a preferred embodiment the cross-sectional diameter of each O-ring 22 is approximately 0.07 inches, and the width of each casing groove 26 is approximately 0.03 inches. While the ratio between the groove width and the cross-sectional O-ring diameter can be varied without losing the advantages of the invention, it is preferable that the ratio be in the approximate range of about 25% to 50%. The depth of recess 24 is approximately 0.055 inches; with only a slight clearance between casing 4 and body 2 the O-ring is therefore compressed adjacent to groove 26 to slightly less than 80% of its normal cross-sectional diameter. Generally, a compression to between about 70% and 85% will give satisfactory results.

With the casing in place over the body as shown in FIG. 1, O-rings 22 form environmental seals that protect the interior of the LMP. The casing cannot easily be dislodged by direct axial forces, yet it has been found that a twisting force on the casing relative to the body coupled with an axial force will readily disengage grooves 26 from O-rings 22 and enable the casing to be removed. The LMP is reassembled simply by sliding the casing over the body and twisting it until O-rings 22 are again crimped in grooves 26. This technique is illustrated in FIG. 2, in which the right hand end of the LMP body is shown in position to be enclosed and sealed by the right hand end of casing 4. As indicated by the arrows, a torque in one direction is applied to the casing, while a torque in the opposite direction is applied to the body. While twisting forces are shown as being applied to both the casing and body, one of these elements could just as well be held stationary and the other twisted. As the two pieces are brought together, O-ring 22 is compressed by the casing until it is aligned with and crimped by groove 26. Assuming the left hand side of the LMP is simultaneously sealed by a similar O-ring/groove assembly, the LMP is now environmentally sealed and the casing securely held in place without the use of any auxiliary fastening devices. To remove the casing it need merely be twisted and drawn off the body.

While a particular embodiment of the invention has been shown and described, numerous additional modifications and variations are possible in light of the above teachings. It is therefore intended that the scope of the invention be limited only in and by the terms of the appended claims.

What is claimed is:

1. A releasable locking and sealing assembly comprising:

in a linear motion potentiometer;

an elongate body having cylindrical end portions, said end portions having an annular recess;

an O-ring disposed in each of said annular recesses formed from a stiffly deformable, springy material having a cross sectional diameter greater than the depth of said annular recess;

a hollow cylindrical casing it fit slidably over said elongate body having an inner diameter at least as great as the outer diameter of said cylindrical end portion but less than the principal diameter of said O-ring compressing said O-ring to between about 70% and 85% of the cross-sectional O-ring diameter; and truncated annular grooves around the interior of said cylindrical casing spaced from each end thereof and adapted to be aligned with said O-ring disposed in each of said annular recesses, each of said annular grooves having lips formed from the edges of said truncated annular grooves defining a groove width of from about 25% to 50% of said cross-sectional diameter of said O-ring forming a bead from said stiffly, deformable, springy O-ring material between said lips within said annular grooves.

2. The sealing assembly of claim 1 wherein the cross-sectional diameter of said O-ring is approximately 0.07 inches, and the width of said annular groove is approximately 0.03 inches.

3. The sealing assembly of claim 2, wherein the depth of the recess in said cylindrical body portion is approximately 0.055 inches.

* * * * *